US010047469B2

(12) United States Patent
Leep

(10) Patent No.: US 10,047,469 B2
(45) Date of Patent: Aug. 14, 2018

(54) LAUNDRY TREATING APPLIANCE WITH OVER-SUDSING CONDITION COMPENSATION MEASURES

(71) Applicant: WHIRLPOOL CORPORATION, Benton Harbor, MI (US)

(72) Inventor: Nicholas Leep, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 159 days.

(21) Appl. No.: 14/976,621

(22) Filed: Dec. 21, 2015

(65) Prior Publication Data

US 2017/0175315 A1 Jun. 22, 2017

(51) Int. Cl.

| | |
|---|---|
| ***D06F 33/00*** | (2006.01) |
| ***D06F 35/00*** | (2006.01) |
| ***D06F 39/02*** | (2006.01) |
| ***D06F 39/00*** | (2006.01) |
| ***D06F 33/02*** | (2006.01) |

(52) U.S. Cl.

CPC ..... *D06F 33/00* (2013.01); *D06F 33/02* (2013.01); *D06F 35/006* (2013.01); *D06F 39/004* (2013.01); *D06F 39/02* (2013.01); *D06F 39/005* (2013.01); *D06F 2202/02* (2013.01); *D06F 2202/12* (2013.01); *D06F 2204/02* (2013.01); *D06F 2232/00* (2013.01)

(58) Field of Classification Search

CPC ..... D06F 33/00

See application file for complete search history.

(56) References Cited

U.S. PATENT DOCUMENTS

| | | | | |
|---|---|---|---|---|
| 4,410,329 | A * | 10/1983 | Blevins | D06F 33/02 68/12.12 |
| 8,388,695 | B2 | 3/2013 | Hendrickson et al. | |
| 2008/0276963 | A1 | 11/2008 | Hendrickson et al. | |
| 2013/0119082 | A1 | 5/2013 | Hendrickson et al. | |

FOREIGN PATENT DOCUMENTS

| | | | |
|---|---|---|---|
| DE | 102009030287 | A1 | 1/2010 |

* cited by examiner

*Primary Examiner* — Jason Ko

(57) ABSTRACT

A method of automatically initiating a procedure to adjust dosing of laundry treating chemistry after satisfying a threshold of determined over-sudsing conditions in a laundry treating appliance during a cycle of operation. When an over-sudsing condition is detected, an over-sudsing counter is initialized, and the data is stored in the memory of a laundry treating appliance as an aggregate total. Once a predetermined threshold is satisfied, a predetermined dosage of laundry treating chemistry is reduced and the over-sudsing counter is reset. The over-sudsing counter can also be reset in the event of an operational event such as a replenishment of a bulk treating chemistry, input by a user of a default value, or passing of a temporal reference, wherein the predetermined dosage is reset to a default value.

14 Claims, 4 Drawing Sheets

LAUNDRY TREATING APPLIANCE WITH OVER-SUDSING CONDITION COMPENSATION MEASURES

BACKGROUND

Laundry treating appliances, such as washing machines, refreshers, and non-aqueous systems, can have a configuration based on a rotating container that defines a treating chamber in which laundry items are placed for treating. The laundry treating appliance can have a controller that implements the cycles of operation having one or more operating parameters. The controller can control a motor to rotate the container according to one of the cycles of operation.

Historically, laundry treating appliances have single dose dispensers, with provided compartments or cups, typically in a drawer or under a cover, in which the user of the appliance would fill with a dose of treating chemistry, such as detergent, that was sufficient for the cycle of operation to be selected. Recently, bulk dispensers, i.e. dispensers holding multiple doses of a treating chemistry, have become more common, yet with single dose dispensers still being dominate.

Some washing machines are capable of determining a presence of an over-sudsing condition in the appliance during a cycle of operation. Over-sudsing conditions occur when too much detergent has been added resulting in excess bubbles and foam in the washer. Bulk detergent systems for washing machines need to "know" the correct dosage of the detergent they are dispensing in order to dispense enough to effectively clean the contents, but not so much as to waste detergent or cause over-sudsing conditions. Typical bulk dispensing systems automatically add the detergent or other treating chemistry to the washer with time and amount determined by the washer's controller. These systems require the user to input the detergent concentration (e.g. 2×, 3×, 6×) for the washing machine to determine dosing. This requires the user to accurately input the concentration, which may not always be present on the label, and for detergent concentration to be uniformly calculated for all detergents. For example, dosing for all "2×" detergents is assumed to be the same, even if a different manufacturer has different dosing guidelines. Over-sudsing conditions could also be caused by manual addition of detergent (e.g. for pre-treating), or from other soaps that end up in the load.

BRIEF SUMMARY

In one aspect, an embodiment of the invention relates to providing a laundry treating appliance which determines a presence of over-sudsing conditions in the appliance during a cycle of operation and is capable of automatically initiating a procedure to adjust dosing of laundry treating chemistry.

In another aspect, an embodiment of the invention relates to a method of operating a laundry treating appliance having a treating chamber for receiving laundry for treatment according to an automatic cycle of operation, the method comprises executing the automatic cycle of operation; determining an over-sudsing condition during the execution of the automatic cycle of operation; increasing a cumulative total of determined over-sudsing conditions in a controller of the laundry treating appliance in response to the determining of an over-sudsing condition; and adjusting a predetermined dosage of a treating chemistry when the cumulative total satisfies a predetermined threshold.

In another aspect, an embodiment of the invention relates to a method of operating a laundry treating appliance having a treating chamber for receiving laundry for treatment according to an automatic cycle of operation, the method comprises executing the automatic cycle of operation including the dispensing of a predetermined dosage of treating chemistry from a bulk dispenser; determining an over-sudsing condition during the execution of the automatic cycle of operation; increasing a cumulative total of determined over-sudsing conditions in a controller of the laundry treating appliance in response to the determining of an over-sudsing condition; and adjusting the predetermined dosage when the cumulative total satisfies a predetermined threshold.

DETAILED DESCRIPTION

The present invention is generally directed towards a laundry treating appliance which automatically adjusts dosing of laundry treating chemistry based on detection of consecutive over-suds conditions when a threshold is satisfied. This allows for compensation of inaccurate user input or change in laundry treating chemistry formulation.

Figure 1:
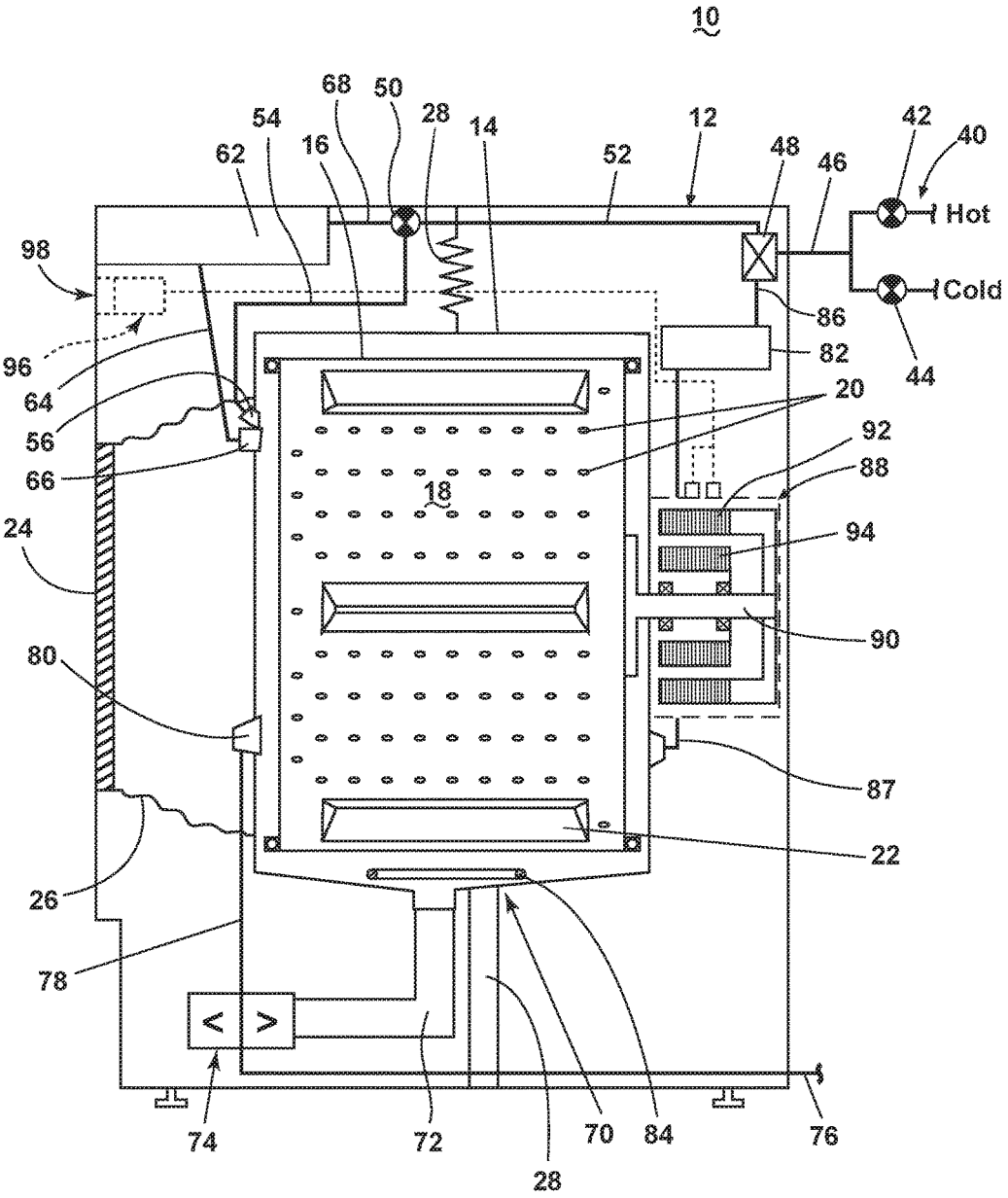
FIG. 1 is a schematic view of a laundry treating appliance in the form of a horizontal washing machine.

Embodiments of the invention can be utilized with a laundry treating appliance in the form of a horizontal-axis washing machine 10 as illustrated in FIG. 1. The horizontal-axis washing machine 10 is exemplary, and use with a laundry treating appliance varying from a horizontal-axis relative to a surface upon which it rests is contemplated, including for example, a vertical-axis washing machine. A structural support system including a cabinet 12 can define a housing within which a laundry holding system resides. The cabinet 12 can be a housing having a chassis and/or a frame, defining an interior, enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a rotatable laundry-container in the form of a drum 16 provided within the tub 14. The drum 16 defines at least a portion of a laundry treating chamber 18 for receiving a laundry load for treatment. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It can also be within the scope of the invention for the laundry holding system to include only a tub with the tub defining the treating chamber.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14. The washing machine 10 can further include a suspension system 28 for dynamically suspending the laundry holding system within the structural support system.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 and can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 62 which can be a single use dispenser, a bulk dispenser or a combination of a single use and bulk dispenser.

Regardless of the type of dispenser used, the dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the second diverter mechanism 50 to direct the flow of water to a dispensing supply conduit 68.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88 for rotationally driving the drum 16. The motor 88 can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled with the drum 16 through a belt and a drive shaft 90 to rotate the drum 16, as is known in the art. Other motors, such as an induction motor or a permanent split capacitor (PSC) motor, can also be used. The motor 88 can rotationally drive the drum 16 including that the motor 88 can rotate the drum 16 at various speeds in either rotational direction. The motor 88 can be configured to rotatably drive the drum 16 in response to a motor control signal.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens, and the like for communicating with the user, such as to receive input and provide output. The user can enter different types of information including, without limitation, laundry treating chemistry concentration and cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller can be a microprocessor-based controller that implements control software and sends/receives one or more electrical signals to/from each of the various working components to effect the control software.

Figure 2:
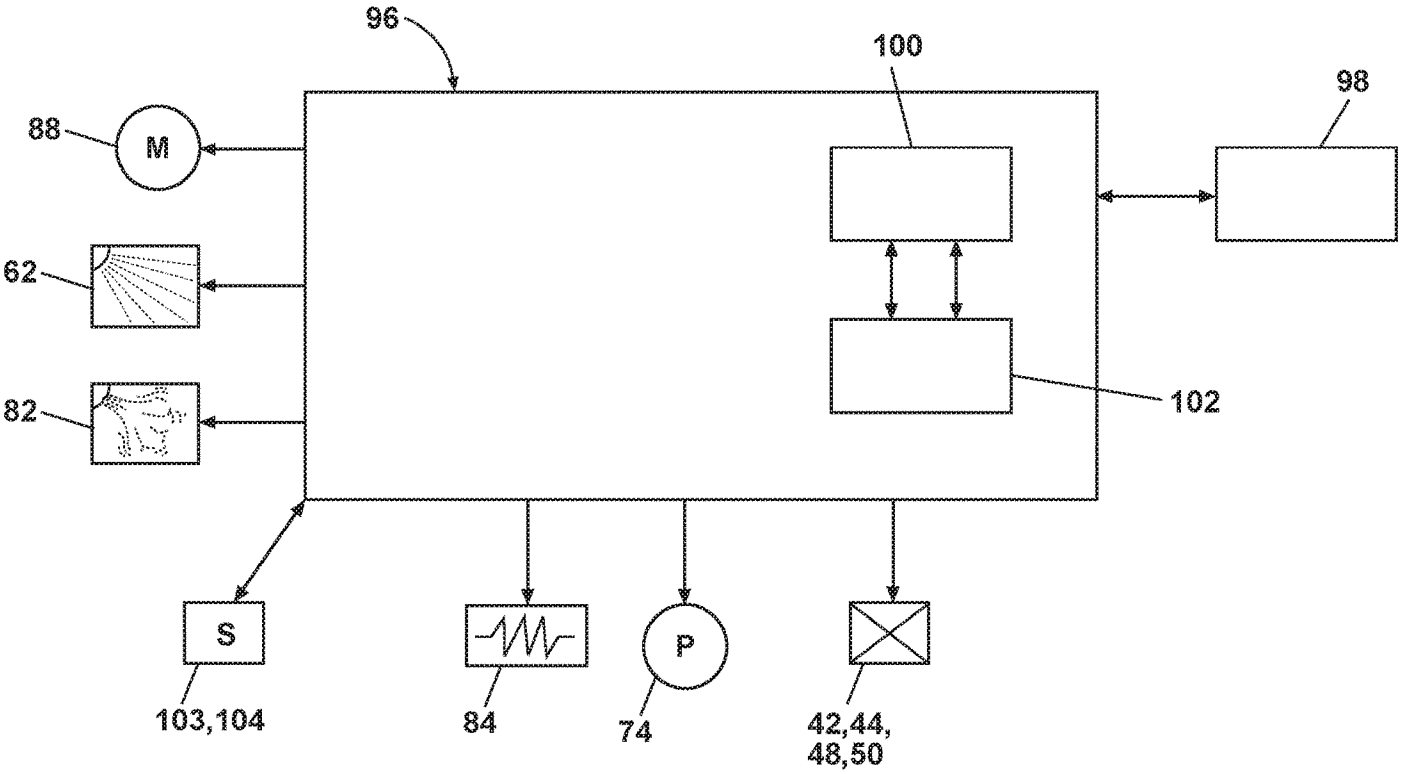
FIG. 2 is a schematic view of a controller for the washing machine of FIG. 1.

As illustrated in FIG. 2, the controller 96 can also be coupled with one or more sensors 103, 104 provided in one or more of the systems of the washing machine 10 to receive input from the sensors. Non-limiting examples of sensors 103, 104 that can be communicably coupled with the controller 96 include: a surfactant sensor, a turbidity sensor, a motor torque sensor, a pressure sensor, a conductivity sensor, a treating chamber temperature sensor, a moisture sensor, a weight sensor, a chemical sensor, a position sensor, an acceleration sensor, a speed sensor, an orientation sensor, an imbalance sensor, a load size sensor, and, which can be used to determine a variety of system and laundry characteristics, such as over-sudsing conditions.

For example, a motor torque sensor, a speed sensor, an acceleration sensor, and/or a position sensor can also be included in the washing machine 10 and can provide an output or signal indicative of the torque applied by the motor, a speed of the drum 16 or component of the drive system, an acceleration of the drum 16 or component of the drive system, and a position sensor of the drum 16. Such sensors 103, 104 can be any suitable types of sensors including, but not limited to, that one or more of the sensors 103, 104 can be a physical sensor or can be integrated with the motor and combined with the capability of the controller 96 to function as a sensor. For example, motor characteristics, such as speed, current, voltage, torque etc., can be processed such that the data provides information in the same manner as a separate physical sensor. In contemporary motors, the motors often have their own controller that outputs data for such information.

The controller 96 can be provided with a memory 100 and a central processing unit (CPU) 102. The memory 100 can be used for storing the control software that can be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components or sensors 103, 104 of the washing machine 10 that can be communicably coupled with the controller 96. The database or table can be used to store the various operating parameters for the one or more cycles of operation, including factory default values for the operating parameters and any adjustments to them by the control system or by user input. Such operating parameters and information stored in the memory 100 can include, but are not limited to, threshold values, predetermined criteria, acceleration ramps, etc.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

Figure 3:
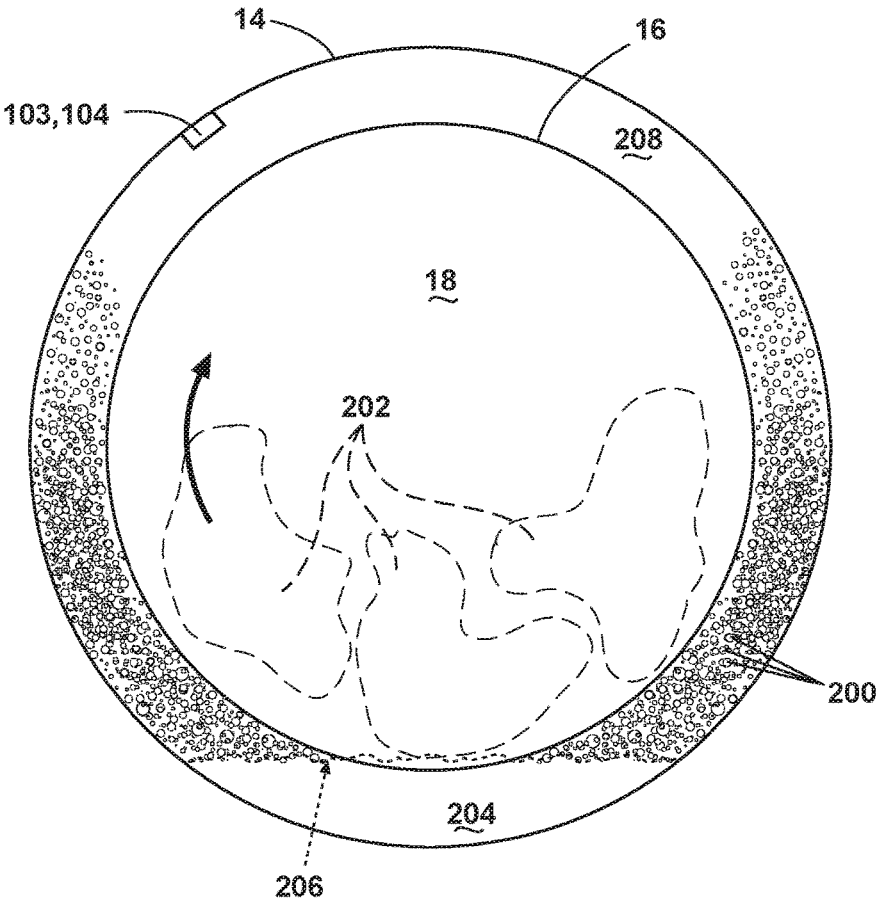
FIG. 3 is a schematic, front view of a tub and rotatable drum during an over-sudsing condition, illustrated by suds.

FIG. 3 is a schematic, front view of the tub 14 and rotatable drum 16 having laundry 202 and a wash liquid 204 defining an operational liquid level 206 within the treating chamber 18. The wash liquid 204 is shown in an over-sudsing condition as illustrated by suds 200, shown extending significantly beyond the operational liquid level 206 of the wash liquid 204. During normal washing operation, the drum 16 is rotated to tumble the laundry 202 in the wash liquid 204, having an operational liquid level 206 that generally has sufficient depth to immerse a lower portion of the drum 16, such that at least portions of the laundry 202 are successively and repeatedly tumbled in the wash liquid 204. During a normal tumbling operation, the suds do not rise much higher than the operational liquid level 206. However, during an over-sudsing condition as shown in FIG. 3, such as when excess detergent or other suds-generating treating chemistry is supplied to the tub 14, excessive suds rise to a much higher level in the space 208 defined between the tub 14 and drum 16.

It is noted that some treating chemistries for a washing cycle may be capable of creating suds, which float and deposit soils and undissolved detergent ingredients, including surfactants, onto the surface of various components of the clothes washing machine 10. For the washing machine 10, it is also noted the deposits tend to build up in areas that are not submerged and/or flushed with adequate volumes of water during standard use of the washing machine 10, which can provide a food supply for micro-organisms that are airborne and introduced into the washing machine 10 with the clothes and accompanying soils that typically comprise a load of dirty laundry. As a result, biofilm can form and grow on the washing machine surfaces, and the biofilm can lead to odor emanating from the washing machine 10 and exposure of the laundry load to these micro-organisms during a cycle of operation of the washing machine 10. In addition, the over-sudsing condition may be unfavorable to the operation of the clothes washing machine 10. For example, the suds or biofilm deposit may adversely affect the treating efficiency of the laundry load by providing less frictional wall of the treating chamber 18 against the laundry load during a tumbling process.

Figure 4:
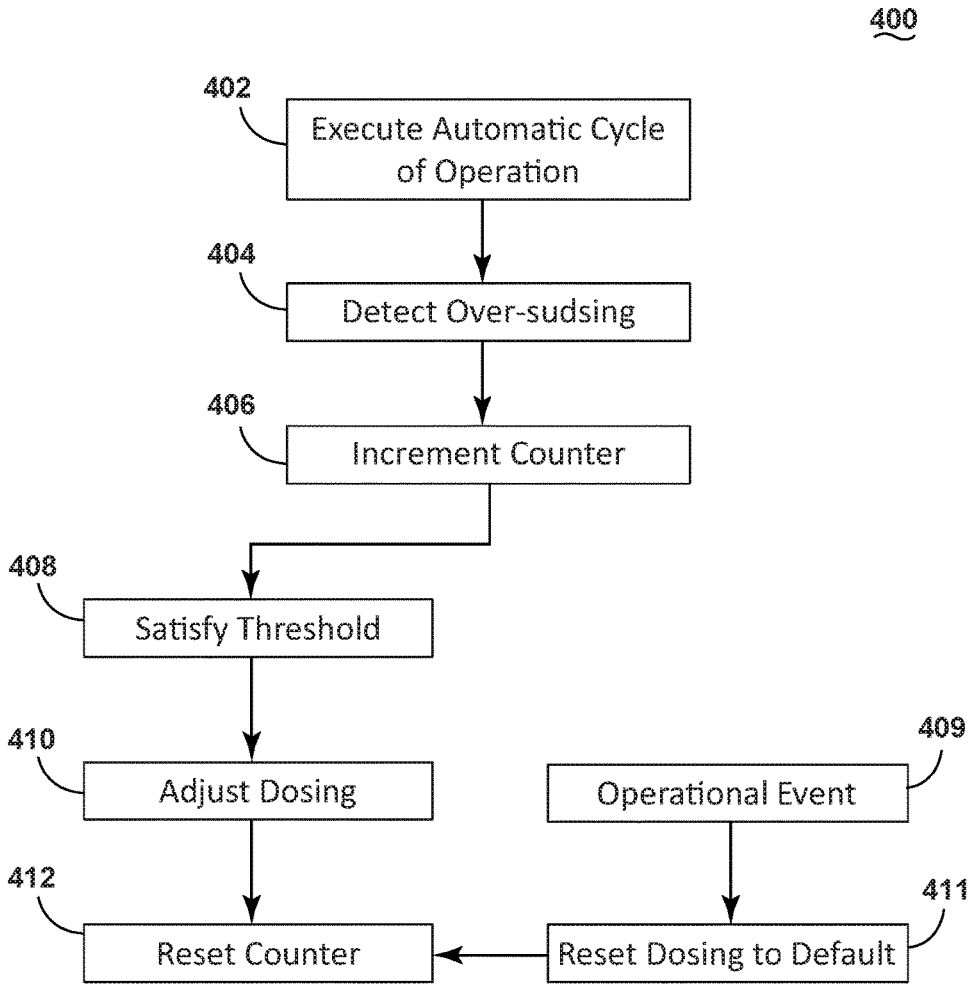
FIG. 4 is a flow chart for operating the clothes washing machine according to an embodiment of the present invention.

It will be apparent to one skilled in the art upon an examination of FIG. 4 that the over-sudsing condition of the washing machine 10 can be remediated by including the steps of the flow chart of FIG. 4 into a typical cycle of the washing machine 10. While the steps of the method illustrated in FIG. 4 are discussed in schematic form, the implementation of these steps into a cycle of operation for the washing machine 10 would be apparent to one skilled in the art of washing machine cycle design and programming. Turning to FIG. 4, an example flow chart is shown for operating the clothes washing machine 10 according to an embodiment of the present invention in a manner to address the problem of over-sudsing conditions by reducing the amount of detergent or other laundry treating chemistry to be dispensed for a cycle of operation, thereby decreasing the likelihood of an occurrence of an over-sudsing condition determination. It will also be understood by one skilled in the art that representative signals of the over-sudsing condition of the washing machine 10 can be provided by sensors, which have been illustrated by example in the various embodiments for the washing machine 10 by reference numerals 103 and 104. Non-limiting examples of the sensors 103, 104 can include a surfactant sensor, motor torque sensor, pressure sensor, conductivity sensor, or turbidity sensor although any other sensors sensing a refractive index, capacitance, surface tension, or turbidity of the suds or suds-containing liquid may be used without departing from the scope of this invention. In addition, the method according to the invention includes the step of adjusting a predetermined dosage of a treating chemistry. This adjustment can include either or both increasing the amount of the dosage of a treating chemistry, or decreasing the amount of a treating chemistry. In addition, in the event a single volume of treating chemistry is introduced during the automatic cycle of operation, the method also contemplates the adjustment of the amount of dosage of a treating chemistry by introducing a counteracting agent to the treating chemistry to dilute or otherwise reduce the effectiveness of the original volume of treating agent.

The method 400 begins at step 402 with the execution of an automatic cycle of operation. In the beginning of the automatic cycle of operation, an over-sudsing counter is initialized to store an aggregate total of over-sudsing conditions detected during the automatic cycle of operation. Detection of over-sudsing conditions can be counted once per cycle where over-sudsing occurs, or the method can be configured to count each over-sudsing condition where over-sudsing occurs multiple times during one cycle. If, during the automatic cycle of operation an over-sudsing condition is detected at step 404, the controller 96 will increment the over-sudsing counter at step 406. If the over-sudsing counter meets or exceeds a pre-determined threshold at step 408, treating effectiveness of the treating chemistry is adjusted at step 410, such as by, for example, reducing a dosage of predetermined dosing of laundry treating chemistry. In one example embodiment, the predetermined dosing is dispensed from a bulk dispenser, and dosing is reduced for subsequent dispensings when the over-sudsing counter satisfies the pre-determined threshold. The same approach can be applied to a single dose dispenser. In the event the over-sudsing counter satisfies the predetermined threshold in a single dose dispensing system, additional or alternate actions can include but are not limited to: the addition of more water for dilution of the wash liquid, draining wash liquid followed by the addition of more water so as to control the volume of the wash liquid, and flushing less of the treating chemistry from the dispenser. Increasing of the cumulative total of over-sudsing condition determinations using the over-sudsing counter at step 406 will occur only when the automatic cycle of operation 402 includes dispensing from the bulk dispenser. However, if the method is configured for use with a single dose dispenser, increasing the over-sudsing counter at step 406 will occur only when the automatic cycle of operation 402 includes dispensing from the single dose dispenser, or in some embodiments, the over-sudsing counter may be increased 406 when either the bulk dispenser or single dose dispenser are utilized.

Once the cumulative number of over-sudsing condition determinations as represented by the over-sudsing counter satisfies a pre-determined threshold 408 and the predetermined dosing of laundry treating chemistry is reduced at step 410, the over-sudsing counter is reset at step 412 and the reduced predetermined dosage is stored in the memory 100. In the event of an operational event 409 such as replenishing a bulk treating chemistry, a user input of the default value, or the passing of a predetermined temporal reference, the predetermined dosage is reset to a default value 411 and the over-sudsing counter is reset at step 412.

A temporal reference can be, for example, at least one of a predetermined number of executed cycles of operation or a predetermined time. The resetting of the default value based on a temporal reference based on the number of cycles is useful for a normal user of the laundry treating appliance, whereas a time-based resetting is useful for a person who infrequently uses the laundry treating appliance.

The sequence of steps depicted in FIG. 4 are for illustrative purposes only, and are not meant to limit the method in any way as it is understood that the steps may process in a different logical order, additional or intervening steps may be included, or described steps may be divided into multiple steps, without detraction from the present invention. For example, in the event of an operational event 409, the cumulative total of over-sudsing condition determinations as represented by the over-sudsing counter may be reset at step 412 prior to resetting the predetermined dosage of laundry treating chemistry to a default value at step 411.

Additionally, it should be appreciated that the aforementioned methods within a horizontal or vertical axis washing machine are exemplary, and use within alternative appliances are contemplated. The methods can alternatively be utilized in additional laundry treating appliances such as a combination washing machine and dryer, a tumbling refreshing/revitalizing machine, an extractor, and a non-aqueous washing apparatus, in non-limiting examples.

The above-described embodiments are more accurate and precise as compared to the existing solutions, as the determinations are driven directly by the defined conditions for operation of the washing machine 10. Furthermore, the above-described embodiments offer solutions that continuously provide information about the operation of the washing machine 10, rather than relying on an extrapolation, which fails to capture the true behavior of the washing machine.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a laundry treating appliance having a treating chamber for receiving laundry for treatment according to automatic cycles of operation, the method comprising:

executing multiple automatic cycles of operation having a predetermined dosage of treating chemistry;

monitoring for an over-sudsing condition during the execution of the automatic cycles of operation;

determining when an over-sudsing condition occurs during the execution of the automatic cycles of operation, wherein the determining when the over-sudsing condition comprises at least one of sensing a surfactant, turbidity, motor torque, pressure, or conductivity value;

increasing a cumulative total of determined over-sudsing conditions in a controller of the laundry treating appliance in response to each determining of an over-sudsing condition; and adjusting the predetermined dosage of a treating chemistry when the cumulative total satisfies a predetermined threshold after the executing of the multiple automatic cycles of operation.

2. The method of claim 1 wherein the executing the automatic cycles of operation comprises dispensing the predetermined dosage from a bulk dispenser.

3. The method of claim 2 wherein the increasing the cumulative total occurs only when the automatic cycles of operation includes the dispensing of treating chemistry from the bulk dispenser.

4. The method of claim 1 wherein the cumulative total is reset upon the adjusting of the predetermined dosage.

5. The method of claim 1 wherein the increasing the cumulative totals occurs only when the determined over-sudsing condition occurs within a predetermined temporal reference.

6. The method of claim 5 wherein the predetermined temporal reference is at least one of a predetermined number of executed cycles of operation or a predetermined time.

7. The method of claim 1 wherein the adjusting the predetermined dosage comprises reducing the predetermined dosage.

8. The method of claim 1 further comprising resetting the predetermined dosage to a default value in response to an operational event wherein the operational event comprises at least one of a replenishment of a bulk treating chemistry, a user input of the default value, or passing of a predetermined temporal reference.

9. The method of claim 8 wherein the operation event comprises passing of a predetermined temporal reference and the predetermined temporal reference is at least one of a predetermined number of executed cycles of operation or a predetermined time.

10. A method of operating a laundry treating appliance having a treating chamber for receiving laundry for treatment according to automatic cycles of operation, the method comprising:

executing multiple automatic cycles of operation including the dispensing of a predetermined dosage of treating chemistry from a bulk dispenser;

monitoring for an over-sudsing condition during the execution of the automatic cycles of operation;

determining when an over-sudsing condition occurs during the execution of the automatic cycles of operation, wherein the determining when the over-sudsing condition comprises at least one of sensing a surfactant, turbidity, motor torque, pressure, or conductivity value;

increasing a cumulative total of determined over-sudsing conditions in a controller of the laundry treating appliance in response to each determining of an over-sudsing condition; and adjusting the predetermined dosage when the cumulative total satisfies a predetermined threshold after the executing of the multiple automatic cycles of operation.

11. The method of claim 10 wherein the cumulative total is reset upon the adjusting of the predetermined dosage.

12. The method of claim 10 wherein the increasing the cumulative total occurs only when the determined over-sudsing condition occurs within a predetermined temporal reference.

13. The method of claim 10 wherein the adjusting the predetermined dosage comprises reducing the predetermined dosage.

14. The method of claim 10 further comprising resetting the predetermined dosage to a default value in response to an operational event wherein the operational event comprises at least one of a replenishment of a bulk treating chemistry, a user input of the default value, or passing of a temporal reference.

* * * * *